United States Patent [19]

Politzer et al.

[11] 3,994,235

[45] Nov. 30, 1976

[54] POWDER ELEMENT

[75] Inventors: Anton Politzer, Lauf, Pegnitz; Hans Sackenreuter, Ruckersdorf; Helmut Könicke, Nurnberg, all of Germany

[73] Assignee: Fa. DIEHL, Nuremberg, Germany

[22] Filed: Apr. 28, 1972

[21] Appl. No.: 249,459

[52] U.S. Cl. ..... 102/101; 102/38; 102/DIG. 1

[51] Int. Cl.[2] ..... F42B 5/18; F42B 9/16

[58] Field of Search ..... 102/101, 38, 39, 40, 102/DIG. 1

[56] References Cited

UNITED STATES PATENTS

| | | | |
|---|---|---|---|
| 1,446,711 | 2/1923 | Ludorf | 102/101 |
| 1,920,075 | 7/1933 | Haenichen | 102/101 |
| 3,073,242 | 1/1963 | Hewson | 102/101 |

*Primary Examiner*—Verlin R. Pendegrass
*Attorney, Agent, or Firm*—Spencer & Kaye

[57] ABSTRACT

A powder element for ammunition not having a shell formed from a cup-shaped pressed propellant powder block with a priming agent mounted on the bottom wall thereof within the cavity defined by the cup-shaped block, and an anvil type propellant charge block, which extends at least partially into the cavity in a substantially mating relationship and abuts the priming agent.

15 Claims, 8 Drawing Figures

POWDER ELEMENT

BACKGROUND OF THE INVENTION

The present invention relates to a powder element for ammunition without shells, i.e., caseless ammunition, particularly for automatic weapons.

Powder elements for ammunition which does not have a shell have already been proposed in which the priming means are fastened in flat bores on the exterior of the powder element. The priming means are thus exposed to damaging environmental influences such as humidity, heat and the like. Additionally, with this arrangement, the danger exists that mechanical influences may loosen or undo the press or adhesive connection of the priming means to the powder element. If the priming means are treated with protective lacquers or adhesive as a means for protection, this can possibly impede the priming sensitivity when the solvents enter into the priming means. Finally, the efficiency of a priming means attached to the exterior of the powder element is also reduced since a portion of the energy released upon priming escapes uselessly through the gap between the outer surface of the powder element and the bottom surface of the combustion chamber. To compensate for this problem, the amount of priming means must be increased.

The Swiss Pat. No. 358,360 discloses ammunition in which a cartridge of a deformable material, for example a thermoplastic, has the priming agent or means embedded on the inside of the bottom piece of the cartridge shell or casing, so that the priming agent is protected against damaging environmental influences. The ammunition proposed in this patent, however, is not ammunition without shells and moreover the specific teachings of this patent cannot be used in the proposed configuration for ammunition without shells.

SUMMARY OF THE INVENTION

It is the object of the present invention to provide a powder element for ammunition without shells in which a priming agent is advantageously disposed so that more effective priming of the powder element is possible.

This is accomplished, according to the present invention, by a powder element having a cup-shaped pressed powder block having a priming means mounted on the bottom wall thereof and within the cavity defined by the cup-shaped powder block. The abutment for the priming means is provided in the form of an anvil block of propellant charge, preferably consisting of pressed powder, which is connected with the cup-shaped powder element and extends at least partially into the cavity in the cup-shaped powder block in substantially mating relationship therewith.

According to an advantageous feature of the invention, priming channels may be provided in the cup-shaped block and/or in the anvil-type block at least some of which are filled at least partially with booster charges.

According to a further advantageous feature of the invention, in order to produce a better adhesive bond by enlarging the contact surfaces between the cup-shaped block and the anvil-type block, the cup-shaped block may have a conical bore, i.e., a conical cavity which narrows in the direction toward the priming means, and the anvil-type block may have the correspondingly shaped conical shaft.

According to still a further feature of the invention, a projectile may be inserted into the front end of the powder element with the rear of the projectile being fastened in a suitable recess in the powder element.

Finally, according to another feature of the invention, in order to provide a simple magazine and to increase combustion of the powder element by bilateral simultaneous firing, two cup-shaped powder blocks may be placed end-to-end to form a common cavity at whose oppositely disposed interior bottoms priming means are mounted and between which an anvil-type propellant charge block is disposed which is connected with both of the cup-shaped powder blocks.

The present invention has the advantage that with the interiorly disposed primer composition, favorable central firing of the powder element is realized which burns without substantial residues and may be supported by booster charges and priming channels. Moreover, the powder element according to the present invention forms a surface which is closed on all sides and has dimensions as small as possible so that the powder element can be provided in a simple manner with coatings or the like which burn or evaporate in a known manner upon firing in order to protect the powder element against water and heat without the priming sensitivity of the priming agent or means being impeded. Furthermore, with the powder element according to the invention, the danger of unintentional firing, which exists to a large degree for powder elements having externally disposed priming agents, is reduced. This is particularly true when the powder element only has a lacquer type coating over its entirety.

DESCRIPTION OF THE PREFERRED EMBODIMENTS

Figure 1:
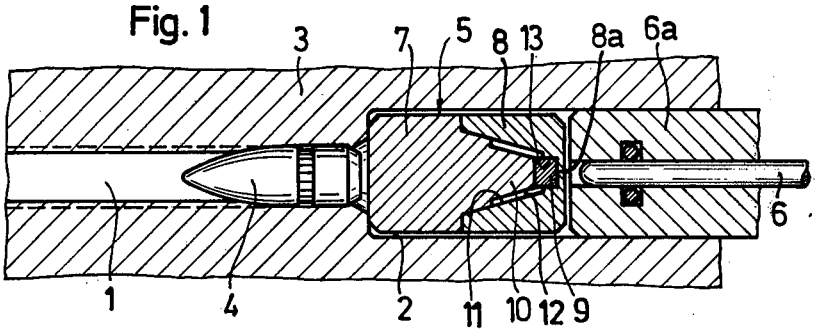
FIG. 1 is a longitudinal section through the cartridge chamber of a weapon for ammunition without shells in a schematic representation of a projectile and an embodiment of a powder element according to the invention.

Referring now to FIG. 1, there is shown a weapon 3 having a projectile 4, a powder element 5 constructed according to the invention, and a firing pin 6 arranged one behind the other in the cartridge 1, 2, thereof. A cartridge chamber lock, which also serves as the guide portion for the firing pin 6 is marked 6*a*.

The powder element 5 according to the invention basically comprises two fitting and adhering (for example, by means of an adhesive) parts or blocks, i.e., an anvil-type block 7 of a propellant charge and a cup-shaped pressed block 8 of powder, and a priming agent in the form of a priming pill 9. The propellant charge block 7, which is preferably also a pressed block of powder, is provided with a rearwardly extending shaft 10, which in the illustrated embodiment is conically shaped.

The axial bore or cavity 11 in the cup-shaped powder block 8 is also conical, narrowing in the direction of the bottom of the block 8, and is of a size so that it will mate with the conical shaft 10 when the shaft extends thereinto. The conical bore 11 ends in a cylindrical blind bore or recess 13 formed in the bottom or end wall of the block 8 so that a bottom wall portion 8*a* of only a few tenths of a millimeter in thickness remains between the cavity 11 and the firing pin 6. The priming means or pill 9 is mounted within the bore 13 and the conical shaft 10 of the propellant charge block 7 is inserted into the cavity 11 so that the priming pill abuts both the end of the conical shaft 10 and the bottom wall portion 8*a*. The firing pin 6 thus penetrates the bottom wall portion 8*a* upon impact and triggers the priming pill 9.

In order to improve the ignition of the powder element 5, one or more priming or firing channels in the form of air gaps in communication with the priming pill 9 may be provided. In the illustrated embodiment such a priming channel is provided by slightly reducing the diameter of the conical shaft along a portion of its length to form a frustoconical superficies shaped air gap 12 along the interface between the blocks 7 and 8 when they are assembled into the powder element 5. It is of course understood that the air gap 12 may also be formed by slightly enlarging the diameter of the bore or cavity 11 in the block 8 along a portion of its length.

Figure 2:
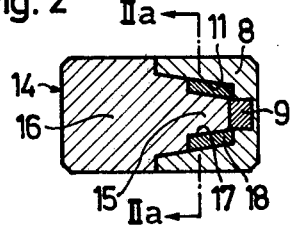
FIGS. 2 and 2*a* are, respectively, a longitudinal sectional view and the corresponding cross-sectional view illustrating a modification of the powder element according to the invention shown in FIG. 1.
Figure 2A:
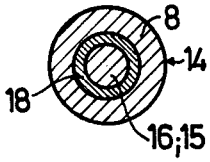

In the embodiment of the powder element 14 according to FIGS. 2 and 2*a*, which corresponds in its principal construction to the powder element 5 of FIG. 1, the conical shaft 15 of the anvil-type propellant charge block 16 of the powder element 14 is staggered in its diameter at approximately half its length. In the resulting cavity 17 between the conical shaft 15 and the interior side wall of the cup-shaped powder block 8 a hollow frustoconically shaped booster charge 18 is disposed. The booster charge 18 is in direct connection with the priming pill 9.

Figure 3:
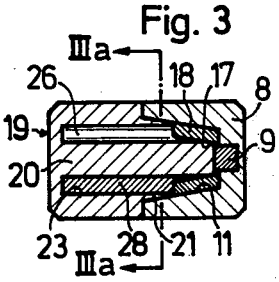
FIGS. 3 and 3*a* are, respectively, a longitudinal sectional view and the corresponding cross-sectional view illustrating another modification of the powder element according to the invention shown in FIG. 1.
Figure 3A:
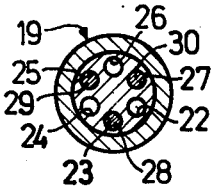

The embodiment of a powder element 19 according to FIGS. 3 and 3*a* is similar to the embodiment of FIGS. 2 and 2*a* in that it also has an anvil-type propellant charge block 20 with a staggered conical shaft 21 and a booster charge 18 in a cavity 17 between the shaft 21 and the interior side wall of the cup-shaped block 8. However, in order to enlarge the ignition surface in the axial direction of the powder element 19, the anvil-type propellant charge block 20 is provided with six longitudinal blind bores 22–27 which extend from the booster charge 18 or from cavity 17, respectively, in the axial direction and are symmetrically disposed in a circle around the longitudinal axis of the block 20.

Of these bores 22–27, three bores 23, 25 and 27 are filled with additional booster charges 28–30, respectively.

Figure 4:
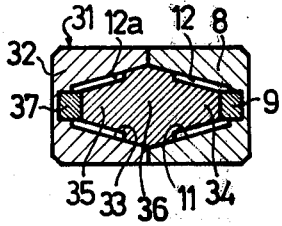
FIG. 4 is a longitudinal sectional view of a further modification of a powder element according to the invention having priming agents disposed at its opposed frontal sides.

The powder element 31 according to FIG. 4 is formed of two identical cup-shaped blocks 8 and 32 (block 8 having been described above in connection with FIG. 1) which are arranged end-to-end with their conical bores directed in opposite directions and are connected by means of an adhesive to form a common cavity. The anvil-type propellant charge block 36 in this embodiment is provided with two oppositely extending conical shafts 34, 35. Priming pills 9 and 37 are embedded in the bottoms of the cup-shaped blocks 8 and 32, respectively. The anvil-type block 36 contacts each of the priming pills 9 and 37 in an abutting relationship with the respective frontal faces of its conical shafts 34 and 35, respectively. The conical air gaps 12, 12*a* formed by the staggered diameters of the conical shafts 34 and 35, respectively, serve to enlarge the ignition surface. With this powder element 31, it is not necessary to observe accurate lateral alignment when placing the powder element in a magazine, since in the cartridge chamber one of the priming pills 9 or 37 will always be disposed opposite firing pin 6.

Figure 5:
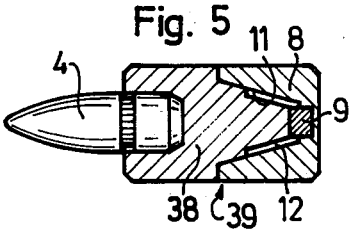
FIGS. 5 and 6 illustrate powder elements according to the invention with the projectile inserted therein, the powder elements being shown in longitudinal section.

In the embodiment of the invention according to FIG. 5, there is shown a powder element 39 wherein the end of the anvil-type propellant charge block 38 opposite the priming pill 9 is provided with a recess or blind bore and the rear end of the projectile 4 is inserted into this blind bore. Otherwise the configuration of powder element 39 corresponds to that of powder element 5 of FIG. 1.

Figure 6:
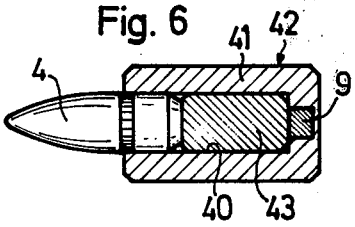

According to FIG. 6, the projectile 4 is fastened with its rear end in a bore 40 of a cup-shaped powder block 41 of a powder element 42. Behind the projectile 4 within the bore 40 is a hard pressed booster or propellant charge block 43 or the like which abuts the bottom of the cup of powder element 42 and the priming agent 9 which is imbedded in the bottom wall of the powder block 41.

The above-mentioned booster charges 18, 28–30, 43 are high-calory charges having a positive oxygen balance. They serve as a compensation for the negative oxygen balance of the binders which bind the individual powder grains into powder blocks.

Advisably, the blocks 7, 8, 16, 18, 20, 28–30, 32, 36, 38, 41 and 43 of powder elements 5, 14, 19, 31, 39, 42 consist of types of powder having different combustion properties in order to realize the best possible approximation to interior ballistic requirements.

Instead of the illustrated rotationally symmetrical cross section, the powder element may also have any other suitable cross section as well as a so-called constant-diameter cross section.

It will be understood that the above description of the present invention is susceptible to various modifications, changes and adaptations and the same are intended to be comprehended within the meaning and range of equivalents of the appended claims.

We claim:

1. A powder element for caseless ammunition, comprising:

a cup-shaped pressed propellant powder block;

a priming means mounted on the bottom wall of said powder block completely within the cavity defined thereby; and an anvil type propellant charge block connected to said cup-shaped pressed powder block and closing said cavity, at least a portion of said propellant charge block extending into said cavity in a mating relationship therewith, the end of said propellant charge block abutting said priming means and serving as an anvil therefore.

2. A powder element as defined in claim 1 wherein said propellant charge block consists of pressed powder.

3. A powder element as defined in claim 1 wherein said priming means is at least partially located in a recess formed in the bottom wall of said cup-shaped powder block, and wherein the thickness of said powder block underlying said priming means is very thin.

4. A powder element as defined in claim 1, including at least one priming channel having one end thereof in communication with said priming means formed completely within said powder element.

5. A powder element as defined in claim 4 wherein said at least one priming channel is formed along the interface of said cup-shaped powder block and said propellant charge block.

6. A powder element as defined in claim 4 wherein said at least one priming channel is sealed with respect to the exterior of said powder element; and further including a booster charge at least partially filling said priming channel, said booster charge abutting said priming means.

7. A powder element as defined in claim 4 wherein said priming channel is formed within said propellant charge block.

8. A powder element as defined in claim 7, including a plurality of said priming channels, which are sealed with respect to the exterior of said powder element, formed within said propellant charge block; and further including a plurality of booster charges at least partially filling some of said priming channels.

9. A powder element as defined in claim 6 further including a plurality of priming channels, which are sealed with respect to the exterior of said powder element, formed within said propellant charge block and each having one end in communication with said booster charge within said at least one priming channel; and a plurality of further booster charges at least partially filling some of said further plurality of priming channels and in communication with said booster charge in said at least one priming channel.

10. A powder element as defined in claim 1, further comprising a further of said cup-shaped pressed powder blocks having a further priming means mounted on the bottom wall thereof and completely within the cavity defined by said further of said cup-shaped powder blocks, said cup-shaped powder blocks being positioned end-to-end so as to form a common cavity; and wherein said propellant charge block is located within said common cavity, forms a mating connection with each of said cup-shaped powder blocks and abuts each of said priming means.

11. A powder element as defined in claim 1 wherein: said cup-shaped powder block has a conically shaped cavity which narrows in the direction of the bottom thereof; and said anvil-type propellant charge block has a correspondingly shaped conical shaft which extends into said conically shaped cavity so as to connect said cup-shaped powder block to said anvil-type propellant charge block.

12. A powder element as defined in claim 10 wherein each of said cup-shaped powder blocks has a conically shaped cavity which narrows in the direction of the bottom thereof and said anvil-type propellant charge block has a pair of oppositely disposed correspondingly shaped conical shafts which extend into the respective ones of the conically shaped cavities so as to connect said cup-shaped powder blocks to said anvil-type propellant charge block.

13. A powder element as defined in claim 1 wherein said powder element is provided with a recess in the end thereof opposite the end at which said priming means is located; and further comprising a projectile inserted and fastened in said recess.

14. A powder element as defined in claim 13 wherein said recess is formed in said anvil-type propellant charge block.

15. A powder element as defined in claim 13 wherein said recess is formed in said cup-shaped powder block.

* * * * *